US011792902B1

(12) United States Patent
Huang

(10) Patent No.: US 11,792,902 B1
(45) Date of Patent: Oct. 17, 2023

(54) REGULATING CIRCUIT CAPABLE OF PREVENTING LOW-TEMPERATURE FLICKERING OF LED LAMP

(71) Applicant: Wuxi Seastar Lighting Co., Ltd., Wuxi (CN)

(72) Inventor: Zhihui Huang, Wuxi (CN)

(73) Assignee: Wuxi Seastar Lighting Co., Ltd., Wuxi (CN)

( * ) Notice: Subject to any disclaimer, the term of this patent is extended or adjusted under 35 U.S.C. 154(b) by 0 days.

(21) Appl. No.: 18/308,663

(22) Filed: Apr. 27, 2023

(30) Foreign Application Priority Data

Jun. 28, 2022 (CN) ..... 202210750972.7

(51) Int. Cl.
*H05B 45/345* (2020.01)
*H05B 45/397* (2020.01)
*H05B 45/325* (2020.01)

(52) U.S. Cl.
CPC ..... *H05B 45/397* (2020.01); *H05B 45/325* (2020.01); *H05B 45/345* (2020.01)

(58) Field of Classification Search
CPC .... H05B 45/10; H05B 45/325; H05B 45/345; H05B 45/397; H05B 45/59; H05B 47/10
See application file for complete search history.

(56) References Cited

U.S. PATENT DOCUMENTS

| | | | | |
|---|---|---|---|---|
| 9,795,001 | B2 | 10/2017 | Ye et al. | |
| 9,860,959 | B2 | 1/2018 | Xiong et al. | |
| 11,519,567 | B2 | 12/2022 | Jiang et al. | |
| 2016/0165682 | A1 | 6/2016 | Wu et al. | |
| 2017/0371363 | A1* | 12/2017 | Habu | G05F 3/26 |

FOREIGN PATENT DOCUMENTS

| | | | |
|---|---|---|---|
| CN | 206894949 | U | 1/2018 |
| CN | 206963164 | U | 2/2018 |
| CN | 209787527 | U | 12/2019 |

* cited by examiner

*Primary Examiner* — Jimmy T Vu
(74) *Attorney, Agent, or Firm* — True Shepherd LLC; Andrew C. Cheng

(57) ABSTRACT

The present disclosure relates to a regulating circuit capable of preventing low-temperature flickering of an light-emitting diode (LED) lamp, including a negative-temperature-coefficient resistor, a forty-sixth linear resistor, a forty-seventh linear resistor, a forty-eighth linear resistor, a fifty-second linear resistor, a fifty-third linear resistor, a fifty-fourth linear resistor, a fourth triode, a fifth triode, a voltage stabilizing diode, an eighth diode, and a common mode choke. The beneficial effect is that a dimming circuit can raise a dimming voltage to around 4 V at −20° C., such that a main control chip exits a burst mode.

7 Claims, 4 Drawing Sheets

REGULATING CIRCUIT CAPABLE OF PREVENTING LOW-TEMPERATURE FLICKERING OF LED LAMP

CROSS-REFERENCE TO RELATED APPLICATIONS

This application claims priority to Chinese Patent Application No. 202210750972.7 with a filing date of Jun. 28, 2022. The content of the aforementioned application, including any intervening amendments thereto, is incorporated herein by reference.

TECHNICAL FIELD

The present disclosure relates to the technical field of light-emitting diode (LED) lighting circuits, and in particular, to a regulating circuit capable of preventing low-temperature flickering of an LED lamp.

BACKGROUND

Dimming is a very common function in the field of LED lighting. As LED light dims from the brightest to the dimmest (for example, 1%), a load of an LED driving power supply gradually changes from heavy to light. In this case, to improve the efficiency and reduce the standby power consumption, a working mode of a main control chip is usually changed to a burst mode, that is, its PWM output becomes interval output.

When a switching frequency is 250 KHz, the main control chip starts to enter the burst mode, and the interval time of the burst is irregular. At room temperature, there is 900 Hz, and human eyes cannot see visible flickering. But at a low temperature of −20° C., the interval frequency becomes about 30 Hz, entering the frequency range where the human eyes can see the flickering.

Visible flickering appears in the lamp when all three conditions of low temperature+light load (dimming to very dark)+the main control chip entering the burst mode are satisfied, so as long as one of the conditions cannot be satisfied, this problem can be avoided.

However, a low temperature of −20° C. for the ambient temperature of the lamp must be satisfied due to practical applications and market considerations. The burst mode and the temperature dependent characteristics are fixed in the main control chip during the design stage, which cannot be changed. Therefore, the only way is to keep the load of the lamp at a certain value in a low-temperature environment (such that the dimming cannot be adjusted to be too dark).

SUMMARY OF PRESENT INVENTION

The objective of the present disclosure is provide a regulating circuit capable of preventing low-temperature flickering of an LED lamp to overcome the above problems existing in the prior art.

To achieve the foregoing technical objectives and technical effects, the present disclosure may be achieved through the following technical solutions:

A dimming circuit includes a negative-temperature-coefficient resistor, a forty-sixth linear resistor, a forty-seventh linear resistor, a forty-eighth linear resistor, a fifty-second linear resistor, a fifty-third linear resistor, a fifty-fourth linear resistor, a fourth triode, a fifth triode, a voltage stabilizing diode, an eighth diode, and a common mode choke; a first terminal of the negative-temperature-coefficient resistor and a first terminal of the forty-seventh linear resistor are connected to a power supply; a second terminal of the negative-temperature-coefficient resistor is connected to a first terminal of the forty-sixth linear resistor; a second terminal of the forty-sixth linear resistor is respectively connected to a base of the fourth triode, a collector of the fourth triode, and a base of the fifth triode; an emitter of the fourth triode is connected to a first terminal of the fifty-second linear resistor; a second terminal of the forty-seventh linear resistor is respectively connected to a collector of the fifth triode, a cathode of the voltage stabilizing diode, and an anode of the eighth diode; an emitter of the fifth triode is connected to a first terminal of the fifty-third linear resistor; a cathode of the eighth diode, a first terminal of the forty-eighth linear resistor, and a first terminal of the fifty-fourth linear resistor are connected to a Dimming interface of a 0-10 V voltage-to-pulse width modulation (PWM) circuit; a second terminal of the forty-eighth linear resistor is connected to a primary output terminal of the common mode choke; a primary input terminal of the common mode choke is a positive input terminal for a dimmer signal, and a secondary input terminal of the common mode choke is a negative input terminal for the dimmer signal; and a second terminal of the fifty-second linear resistor, a second terminal of the fifty-third linear resistor, an anode of the voltage stabilizing diode, the second terminal of the fifty-fourth linear resistor, and a secondary output terminal of the common mode choke are connected to a signal ground.

The present disclosure has the following beneficial effects: the dimming circuit can raise a dimming voltage to around 4 V at −20° C., such that the main control chip exits the burst mode; and the lamp is kept in dark dimming at normal temperature, and the dimming level is automatically improved at low temperature, to eliminate the problem of light flickering at low temperature and small dimming.

BRIEF DESCRIPTION OF THE DRAWINGS

The accompanying drawings described here are provided for further understanding of the disclosure, and constitute a part of the application. The exemplary embodiments and illustrations thereof of the disclosure are intended to explain the disclosure, but do not constitute inappropriate limitations to the disclosure. In the accompanying drawings.

Figure 1:
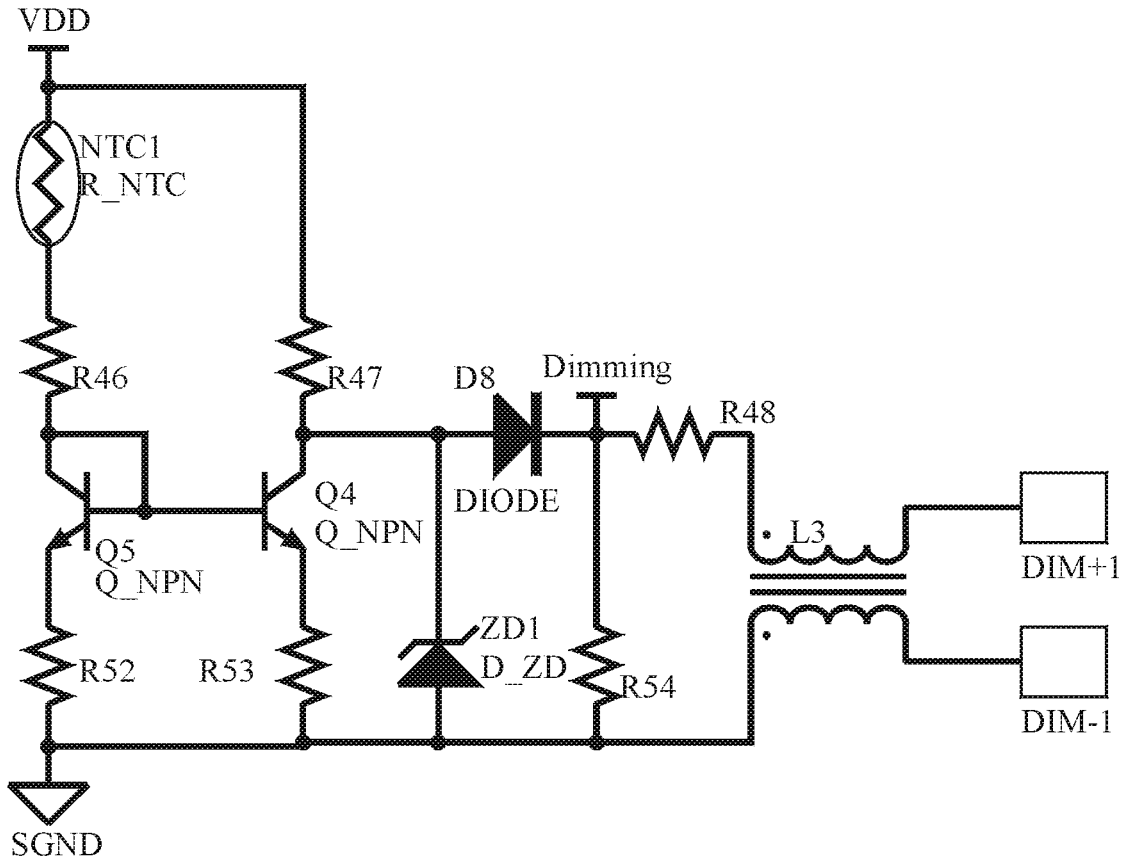
FIG. 1 is a schematic diagram showing a self-adaptive dimming circuit according to the present disclosure.

Reference numerals: Negative-temperature-coefficient resistor—NTC1, Forty-sixth linear resistor—R46, Forty-seventh linear resistor—R47, Forty-eighth linear resistor—R48, Fifty-second linear resistor—R52, Fifty-third linear resistor—R53, Fifty-fourth linear resistor—R54, Fourth triode—Q4, Fifth triode—Q5, Voltage stabilizing diode—ZD8, Eighth diode—D8, and Common mode choke—L3.

DETAILED DESCRIPTION OF THE EMBODIMENTS

The present disclosure will be described in detail below with reference to the accompanying drawings and the embodiments.

Figure 2:
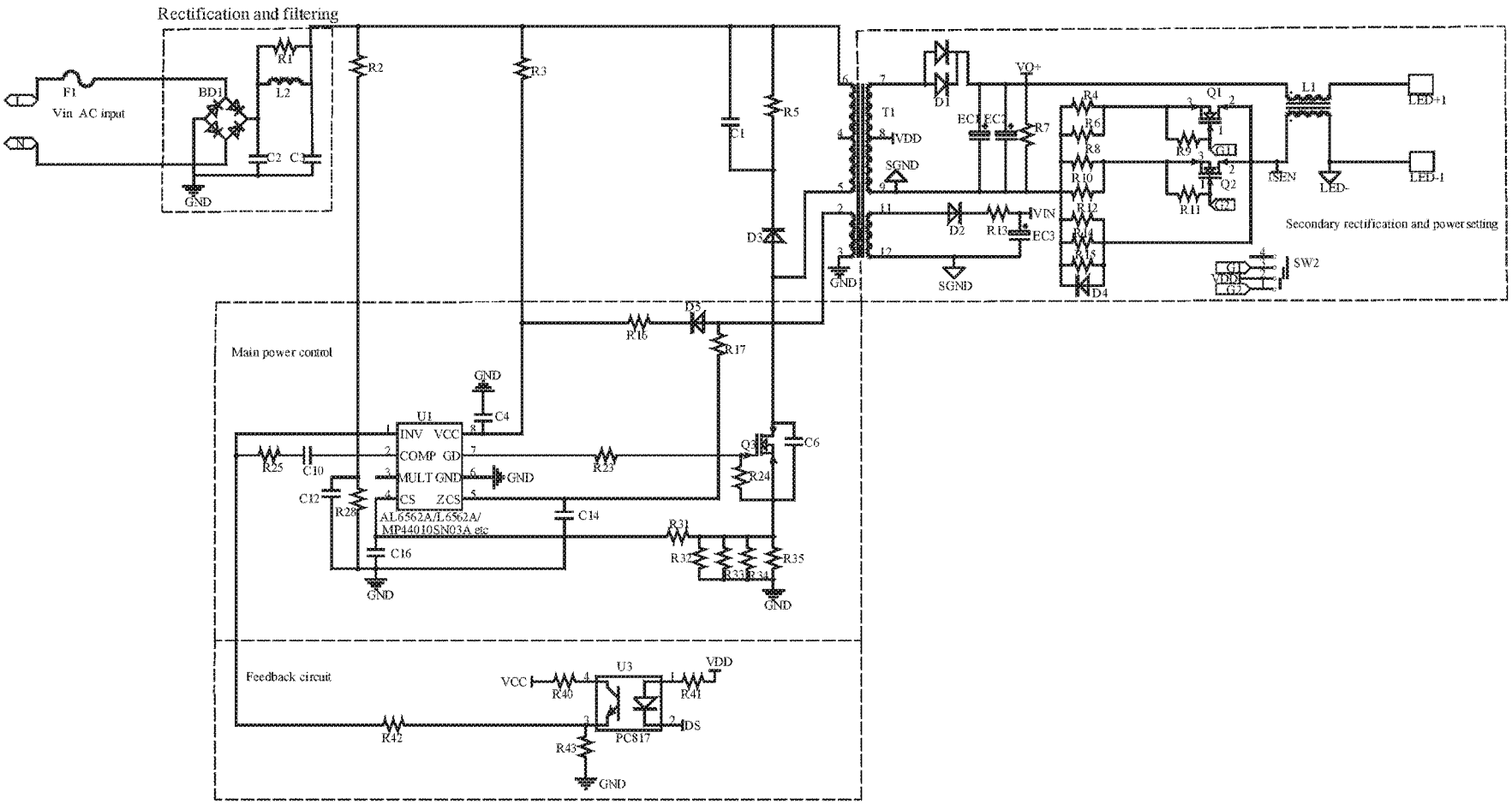
FIG. 2 is a schematic diagram showing a dimming circuit according to the present disclosure.
Figure 3:
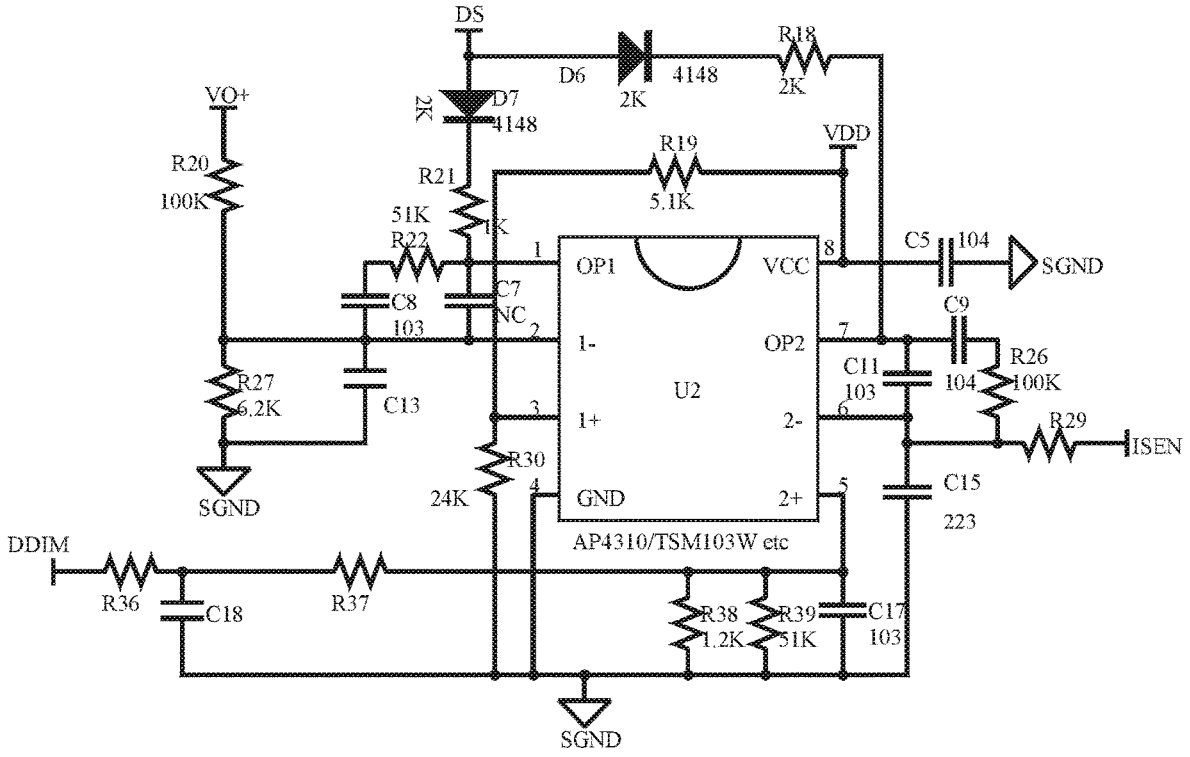
FIG. 3 is a schematic diagram showing a circuit for secondary side voltage/current detection.
Figure 4:
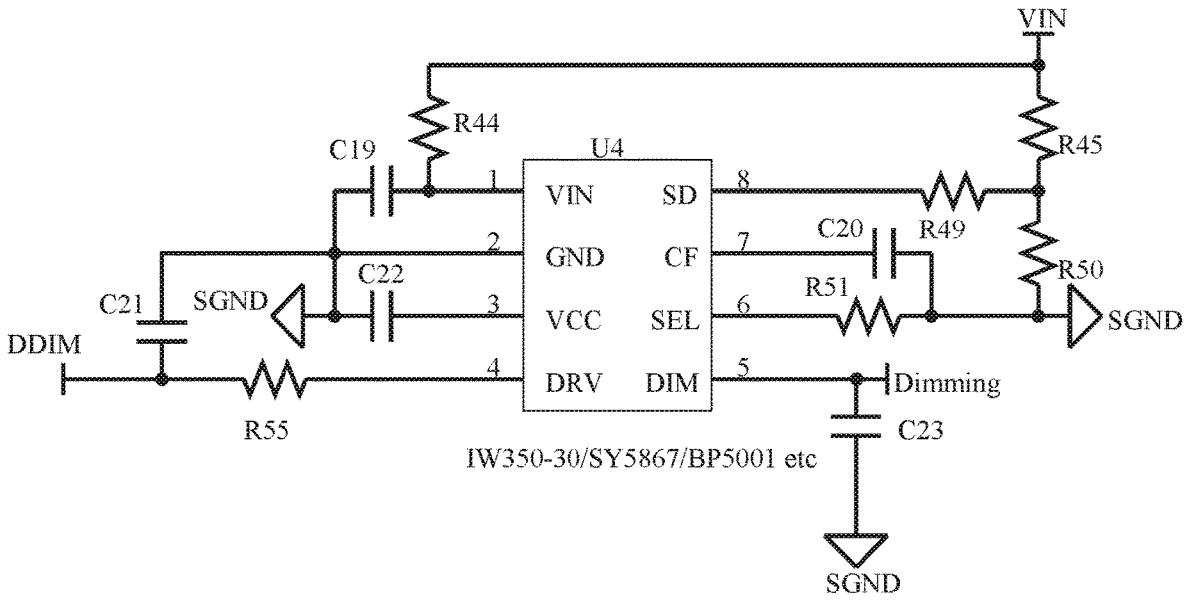
FIG. 4 is a schematic diagram showing a circuit for converting 0~10V voltage to PWM voltage.

As shown in FIG. 1 to FIG. 4, a regulating circuit capable of preventing low-temperature flickering of an LED lamp includes a negative-temperature-coefficient resistor NTC1 whose resistance increases with decreasing temperature, a forty-sixth linear resistor R46, a forty-seventh linear resistor R47, a forty-eighth linear resistor R48 for port current limiting, a fifty-second linear resistor R52 serving as a current negative-feedback resistor, a fifty-third linear resistor R53 serving as a current negative-feedback resistor, a fifty-fourth linear resistor R54 for voltage division, a fourth triode Q4, a fifth triode Q5, a voltage stabilizing diode ZD8 serving as a voltage clamp, an eighth diode D8 for preventing a current from flowing backward, and a common mode choke L3 for inhibiting common mode interference. A first terminal of the negative-temperature-coefficient resistor NTC1 and a first terminal of the forty-seventh linear resistor R47 are connected to a power supply VDD; a second terminal of the negative-temperature-coefficient resistor NTC1 is connected to a first terminal of the forty-sixth linear resistor R46; a second terminal of the forty-sixth linear resistor R46 is respectively connected to a base of the fourth triode Q4, a collector of the fourth triode Q4, and a base of the fifth triode Q5; an emitter of the fourth triode Q4 is connected to a first terminal of the fifty-second linear resistor R52; a second terminal of the forty-seventh linear resistor R47 is respectively connected to a collector of the fifth triode Q5, a cathode of the voltage stabilizing diode ZD8, and an anode of the eighth diode D8; an emitter of the fifth triode Q5 is connected to a first terminal of the fifty-third linear resistor R53; a cathode of the eighth diode D8, a first terminal of the forty-eighth linear resistor R48, and a first terminal of the fifth-fourth linear resistor R54 are connected to a Dimming interface of a 0-10 V voltage-to-PWM circuit; a second terminal of the forty-eighth linear resistor R48 is connected to a primary output terminal of the common mode choke L3; a primary input terminal of the common mode choke L3 is a positive input terminal DIM+1 for a dimmer signal, and a secondary input terminal of the common mode choke L3 is a negative input terminal DIM−1 for the dimmer signal; and a second terminal of the fifty-second linear resistor R52, a second terminal of the fifty-third linear resistor R53, an anode of the voltage stabilizing diode ZD8, a second terminal of the fifty-fourth linear resistor R54, and a secondary output terminal of the common mode choke L3 are connected to a signal ground SGND.

In this embodiment, a type of the negative-temperature-coefficient resistor NTC1 is TTC3A102□39D*. The forty-sixth linear resistor R46 has a resistance of 0.75 KΩ, the forty-seventh linear resistor R47 has a resistance of 2 KΩ, the forty-eighth linear resistor R48 has a resistance of 2 KΩ, the fifty-second linear resistor R52 has a resistance of 1 KΩ, the fifty-third linear resistor R53 has a resistance of 1 KΩ, and the fifty-fourth linear resistor R54 has a resistance of 100 KΩ. Both the fourth triode Q4 and the fifth triode Q5 are 2N3904 triodes. The voltage stabilizing diode ZD8 is a 1N750 2D voltage stabilizing diode. The eighth diode D8 is a 1N4148 high-speed switching diode. The common mode choke L3 has an inductance of 100 μH.

The negative-temperature-coefficient resistor NTC1, the forty-sixth linear resistor R46, the forty-seventh linear resistor R47, the fourth triode Q4, the fifth triode Q5, the fifty-second linear resistor R52, and the fifty-third linear resistor R53 constitute a mirror constant-current source. A base and a collector of the fifth triode Q5 are connected, and therefore, Uce of the fifth triode Q5 is equal to Ube, that is, the fifth triode Q5 is in an amplified state, a current amplification coefficient is set as β, and a collector current Ic of the fifth triode Q5 is equal to β*Ib. In addition, the base of the fifth triode Q5 is directly connected to a base of the fourth triode Q4, an emitter of the fifth triode Q5 is indirectly connected to an emitter of the fourth triode Q4, and therefore, a base current Ib1 of the fifth triode Q5 and a base current Ib2 of the fourth triode Q4 are equal to Ib, and a collector current Ic1 of the fifth triode Q5 and a collector current Ic2 of the fourth triode Q4 are equal to Ic, namely β*Ib. In view of the above, due to such a special connection of the circuit, the collector Ic1 of the fifth triode Q5 and the collector Ic2 of the fourth triode Q4 are in a mirror-image relationship, so this circuit is called a mirror constant-current source.

The fifty-second linear resistor R52 and the fifty-third linear resistor R53 are current negative-feedback resistors, and can constitute a proportional constant-current source circuit. Compared with a mirror constant-current source circuit, the output current Ic of the proportional constant-current source has a higher stability. When R52=R53, Ic1 is still equal to Ic2.

Working principle: at normal temperature, because the resistance of the negative-temperature-coefficient resistor is small, the current Ic1 flowing on the collector of the fourth triode is large, a voltage drop formed on the forty-seventh linear resistor is large, and finally, a voltage shared by both terminals of the fifty-fourth linear resistor is low, which does not affect normal dimming depth of the dimmer at room temperature. When the temperature drops, the resistance of the negative-temperature-coefficient resistor becomes large, the current Ic1 flowing on the collector of the fourth triode becomes small, the voltage divided by the forty-seventh linear resistor becomes small, and the voltage shared by both terminals of the fifty-fourth linear resistor increases, which improves the dimming level at low temperature. Therefore, the dimming depth can be increased as the temperature drops, such that the main control chip cannot enter the burst working mode in a low-temperature working state.

Description of main characteristic parameters of the power supply:

(1) the input is 120-277 Vac, and the output is 36 V and 520 mA;

(2) there are three levels of power, and the lowest level of power is 40% of the highest level; and (3) the dimming is within 0-10 V, and the dimming depth is 5%; and (4) the lowest working temperature is −20° C.

When the input is 277 Vac, and the load power is about 2.5 W (the output current is 80 mA, and the VF of the LED is 32 V), the main control chip enters the burst mode. At the lowest level of the three levels of power, the maximum current is 200 mA. When the corresponding output current is 80 mA, the dimming voltage is about 3-4 V, so a low-temperature dimming adaptive circuit can raise the dimming voltage to around 4 V at −20° C., such that an IC exits the burst mode.

The basic principles, main features, and advantages of the present disclosure are described above. Those skilled in the art should understand that the present disclosure is not limited by the above embodiments, and the descriptions in the above embodiments and specification are merely used for illustrating principles of the present disclosure. The present disclosure may have various modifications and improvements without departing from the spirit and scope of the present disclosure, and all these modifications and improvements should fall within the protection scope of the present disclosure.

What is claimed is:

1. A regulating circuit capable of preventing low-temperature flickering of an light-emitting diode (LED) lamp, comprising a negative-temperature-coefficient resistor, a forty-sixth linear resistor, a forty-seventh linear resistor, a forty-eighth linear resistor, a fifty-second linear resistor, a fifty-third linear resistor, a fifty-fourth linear resistor, a fourth triode, a fifth triode, a voltage stabilizing diode, an eighth diode, and a common mode choke, wherein a first terminal of the negative-temperature-coefficient resistor and a first terminal of the forty-seventh linear resistor are connected to a power supply;

a second terminal of the negative-temperature-coefficient resistor is connected to a first terminal of the forty-sixth linear resistor;

a second terminal of the forty-sixth linear resistor is respectively connected to a base of the fourth triode, a collector of the fourth triode, and a base of the fifth triode;

an emitter of the fourth triode is connected to a first terminal of the fifty-second linear resistor;

a second terminal of the forty-seventh linear resistor is respectively connected to a collector of the fifth triode, a cathode of the voltage stabilizing diode, and an anode of the eighth diode;

an emitter of the fifth triode is connected to a first terminal of the fifty-third linear resistor;

a cathode of the eighth diode, a first terminal of the forty-eighth linear resistor, and a first terminal of the fifth-fourth linear resistor are connected to a Dimming interface of a 0-10 V voltage-to-pulse width modulation (PWM) circuit;

a second terminal of the forty-eighth linear resistor is connected to a primary output terminal of the common mode choke;

a primary input terminal of the common mode choke is a positive input terminal for a dimmer signal, and a secondary input terminal of the common mode choke is a negative input terminal for the dimmer signal;

a second terminal of the fifty-second linear resistor, a second terminal of the fifty-third linear resistor, an anode of the voltage stabilizing diode, a second terminal of the fifty-fourth linear resistor, and a secondary output terminal of the common mode choke are connected to a signal ground;

the negative-temperature-coefficient resistor, the forty-sixth linear resistor, the forty-seventh linear resistor, the fourth triode, the fifth triode, the fifty-second linear resistor, and the fifty-third linear resistor constitute a mirror constant-current source;

a base and a collector of the fifth triode (Q5) are connected, the fifth triode (Q5) is in an amplified state, a current amplification coefficient is set as β, and a collector current (Ic) of the fifth triode (Q5) is equal to β*Ib, wherein Ib is a base current of the fifth triode; and the base of the fifth triode (Q5) is directly connected to a base of the fourth triode Q4, an emitter of the fifth triode Q5 is indirectly connected to an emitter of the fourth triode Q4, the base current of the fifth triode (Q5) and a base current of the fourth triode (Q4) are equal to each other, and the collector current of the fifth triode Q5 and a collector current of the fourth triode (Q4) are equal to each other.

2. The regulating circuit according to claim 1, wherein a type of the negative-temperature-coefficient resistor is TTC3A102.

3. The regulating circuit according to claim 1, wherein the forty-sixth linear resistor has a resistance of 0.75 KΩ, the forty-seventh linear resistor has a resistance of 2 KΩ, the forty-eighth linear resistor has a resistance of 2 KΩ, the fifty-second linear resistor has a resistance of 1 KΩ, the fifty-third linear resistor has a resistance of 1 KΩ, and the fifty-fourth linear resistor has a resistance of 100 KΩ.

4. The regulating circuit according to claim 1, wherein a type of the fourth triode and the fifth triode is 2N3904.

5. The regulating circuit according to claim 1, wherein a type of the voltage stabilizing diode is 1N750 2D.

6. The regulating circuit according to claim 1, wherein a type of the eighth diode is 1N4148.

7. The regulating circuit according to claim 1, wherein the common mode choke has an inductance of 100 μH.

* * * * *